US007114705B2

(12) United States Patent
Steiner

(10) Patent No.: US 7,114,705 B2
(45) Date of Patent: Oct. 3, 2006

(54) GRAB-ACTIVATED SELF-LOCKING WINCH HANDLE

(76) Inventor: Donald J. Steiner, 9 Old Kings Hwy., Norwalk, CT (US) 06850

( * ) Notice: Subject to any disclaimer, the term of this patent is extended or adjusted under 35 U.S.C. 154(b) by 0 days.

(21) Appl. No.: 11/058,761

(22) Filed: Feb. 16, 2005

(65) Prior Publication Data

US 2005/0229739 A1 Oct. 20, 2005

Related U.S. Application Data

(60) Provisional application No. 60/557,898, filed on Mar. 30, 2004.

(51) Int. Cl.
*B66D 1/00* (2006.01)

(52) U.S. Cl. ..... 254/266; 254/344; 74/545; 81/60; 81/177.85; 403/328; 403/329

(58) Field of Classification Search ..... 254/266, 254/342, 344; 74/545, 548; 81/177.85, 81/60, 180.1; 403/325, 326, 328, 329
See application file for complete search history.

(56) References Cited

U.S. PATENT DOCUMENTS 3,117,484 A 1/1964 Myers ..... 85/5
3,167,338 A * 1/1965 Troike ..... 403/354
3,474,506 A 10/1969 Metz ..... 24/211
3,532,013 A 10/1970 Haznar ..... 81/62
3,575,015 A * 4/1971 Geisthoff et al. ..... 464/23
3,608,936 A * 9/1971 Karden ..... 403/9
3,713,356 A 1/1973 Knudsen ..... 81/177
3,758,938 A 9/1973 Simmons et al. ..... 29/400
3,762,245 A 10/1973 Smyers et al. ..... 81/177
3,777,596 A 12/1973 Smyers et al. ..... 81/177
3,865,500 A * 2/1975 Newell ..... 403/359.5
4,187,747 A 2/1980 Pawlow ..... 81/177
4,602,534 A 7/1986 Moetteli ..... 81/177
4,883,255 A * 11/1989 Bacon ..... 254/266
4,991,361 A 2/1991 Huppert et al. ..... 51/346
5,833,218 A * 11/1998 Sand ..... 267/64.25
6,006,631 A 12/1999 Milner et al. ..... 81/177
6,276,239 B1 8/2001 Albertson ..... 81/59
6,491,285 B1 * 12/2002 Tomita ..... 254/266

* cited by examiner

*Primary Examiner*—Emmanuel M Marcelo
(74) *Attorney, Agent, or Firm*—Perman & Green, LLP

(57) ABSTRACT

A lock/release mechanism for the crank handle of a winch consists of a set of one or more pins that are captured within the drive head of the handle. Within the drive head is an actuation rod, which acts on these pins. Depending on the position of the rod, the pins are either moved or pushed outward (lock position), or retracted into the drive head (unlock position). The actuation rod is moved by means of a lever that enables removal of the crank handle with one hand.

14 Claims, 7 Drawing Sheets

GRAB-ACTIVATED SELF-LOCKING WINCH HANDLE

RELATED APPLICATION

This application claims priority from U.S. Provisional Application for Patent Ser. No. 60/557,898, filed, Mar. 30, 2004.

BACKGROUND OF THE INVENTION

1. Field of the Invention

This application relates to apparatus for releasably driving a winch. More particularly a crank handle is described for driving winches of the kind used on sailing vessels. The crank having a releasable locking mechanism at the interface between crank and winch that allows one handed removal of the crank from the winch.

2. Brief Description Of Related Developments

Winches are generally constructed having a drum that is mounted on a platform for rotation about an axis. The drum is driven by engagement with a crank arm that extends transverse to the axis to provide a mechanical advantage. Such crank and winch devices are well known. In use a rope or line to be hauled is wrapped several turns about the drum and the drum is driven in rotation by manual operation of the crank arm. Rotation of the drum causes the line to be drawn in by further wrapping the line about the drum.

Sailboats (usually of length greater than 25 feet) typically employ the use of winches to control the lines ("sheets") that are attached to the sails. These winches are usually deck mounted and operated by means of a crank handle. The winch drum is constructed with an axially aligned socket having an octagonal cross section. A male drive head is constructed on the crank with a matching octagonal cross section. The drive head of the crank fits into the octagonal socket, generally located at the top of the winch drum. Winch cranks come in a wide variety of shapes, sizes, and construction material, but share the common octagonal shape and size of the drive, which fits into the winch itself.

In operation the crank is engaged in the drum and cranked in a circular motion. If a line has been wrapped around the winch drum, this circular motion turns the drum and causes the line to be hauled in. In applications for marine and sailing use, the crank is generally designed to be removed from the drum when not being cranked. This requires a releasable locking mechanism to prevent the crank from becoming dislodged. More often than not, this results in the handle being lost overboard.

A crank, typical of those currently used, is shown in FIG. 1. The locking mechanism of this prior art crank handle consists of a square plate located at the bottom of the drive head. The locking plate is mounted on a shaft that extends through a bore in the drive head of the crank arm. The shaft is allowed to rotate thereby, moving the plate from alignment with the octagonal cross section to a position in which it interferes with a shoulder at the bottom of the drive socket within the winch body. The rotation of the locking plate is accomplished by means of a small finger lever located at the top of the locking plate shaft. In general the locking plate shaft is spring biased in the locked position and therefore must be rotated into alignment in order to attach or release the crank. Not all crank handles in use today are the locking type. Those that are, however, generally employ this type of locking mechanism. Another prior art locking mechanism is shown in U.S. Pat. No. 6,491,285.

While effective, this rotating locking plate is fully exposed and is often damaged as the winch handle is repeatedly engaged or disengaged from the winch. This is especially true in the case of sailboat racing where frequent (often abusive) use of the crank is common. Damage to the locking plate can result in the winch handle becoming captured within the winch making it difficult or impossible to release.

As shown in FIG. 9, the drive head of the prior art presents a flat surface 50 to the socket opening having an octagonal cross section. Therefore, it is necessary to align the mating profiles with some precision. This creates an inherent difficulty in aligning the female and male parts of the winch and drive head, especially as a sailing vessel, rolls, pitches, and yaws under sail. In is an object of this invention to facilitate the engagement of the drive head in the socket.

Another disadvantage of crank handles using the locking plate type of mechanism is that it generally requires the use of both hands to engage or disengage the handle. While it is possible to release the handle with one hand using the thumb to unlock, this may be awkward because of the length of the crank arm. In practice both hands are commonly used to accomplish this task. Typically, one hand is used to operate the finger lever, while the other hand is used to pull the handle upward to free it from the winch drum. Given the three-directional movement of a sailboat underway, using both hands to attend any piece of equipment is inconvenient and often dangerous. This is especially true in a race situation where accurate and timely executions of sail trim actions are critical.

It is a purpose of this invention to provide a mechanism for reliably locking and releasing the drive head of a crank. It is also a purpose of this invention that the engagement and release operation can be accomplished with one hand.

SUMMARY OF THE INVENTION

A handle assembly for cranking a winch is constructed with a lever action engagement and release mechanism. The handle is particularly adapted for use in cranking a winch for use in marine or other applications in which the winch is designed for operation with a removable crank handle. The winch is generally comprised of a drum mounted for rotation on a fixed surface in convenient access to ropes or lines that need to be frequently hauled, such as the sheets connected to the various sails of a sailboat. The drum is driven by means of a crank that is engaged in a socket in the drum. Generally the socket is axially aligned with the axis of rotation of the drum. A drive head, configured to mate with the socket, extends outward from the crank in a conventional manner. The socket is formed to a predetermined diameter and a depth below which is an area of enlarged diameter sufficient to provide a shoulder for engagement of a locking mechanism, as shown if FIG. 1. The crank is comprised of a crank arm extending radially outward from the drive head to provide a mechanical advantage.

In one aspect of the invention, the locking mechanism comprises an array of pins, that are mounted for radial movement within the drive head of the crank at a depth sufficient to clear below the shoulder when the drive head is fully mated with the socket and the pins are radially extended. An actuating shaft is mounted in an axial bore constructed in the drive head and extends through the bore to allow engagement of the actuating shaft. The engaging end of the actuating shaft is provided with a cam surface for engagement with the pins. The pins are spring biased in the radially inward direction, and the shaft is spring biased towards engagement of the pins. In the engaged position, radially inward movement of the pins is limited and the outer ends of the pins extend beyond the profile of the drive head for engagement with the shoulder at the bottom of the socket. In the normal position, therefore, the pins are held in the locking position. Depression of the actuating shaft allows the pins to retract into the drive head bore under the influence of the bias spring thereby permitting the user to insert or remove the crank from the winch.

In another aspect of the invention, the actuating shaft may be depressed by means of a lever mounted on the crank arm and extending parallel to the longitudinal axis of the crank arm. The upper end of the actuating shaft extends beyond the surface of the crank arm and is connected to the lever in a manner which allows pivotal movement between shaft and lever. The lever is connected at its other end to the crank arm, also in a manner that allows pivotal movement between lever and arm. The lever therefore, has a fulcrum at the end away from the connection to the actuating shaft and is spring biased to draw the actuating shaft upward into the locked position. The lever may be easily grasped with the crank arm and compressed against the crank arm to depress the actuating shaft and allow the pins to be retracted, thereby releasing the crank.

In another aspect of this device, the profile of the drive head, at its insertion end, is altered to promote alignment of the matching profiles of drive head and socket. The octagonal shape of the drive head is defined by 8 triangular shaped projections extending parallel with the longitudinal axis of the drive head. According to this invention, the sides of each of the triangular projections are beveled at an angle upward from a plane perpendicular to the longitudinal axis of the drive head. Each of the beveled sides of a projection will intersect in a line which is also beveled upward in a plane parallel to and intersecting with the longitudinal axis, i.e. along the outer edge of each projection. This results in the engaging surface of the drive head presenting a compound beveled surface on each of the triangular projections, thereby facilitating insertion of the drive head in the socket.

DESCRIPTION OF THE DRAWING

The invention is described in more detail below with reference to the attached drawing in which.

DETAILED DESCRIPTION OF AN EMBODIMENT OF THIS INVENTION

Figure 1:
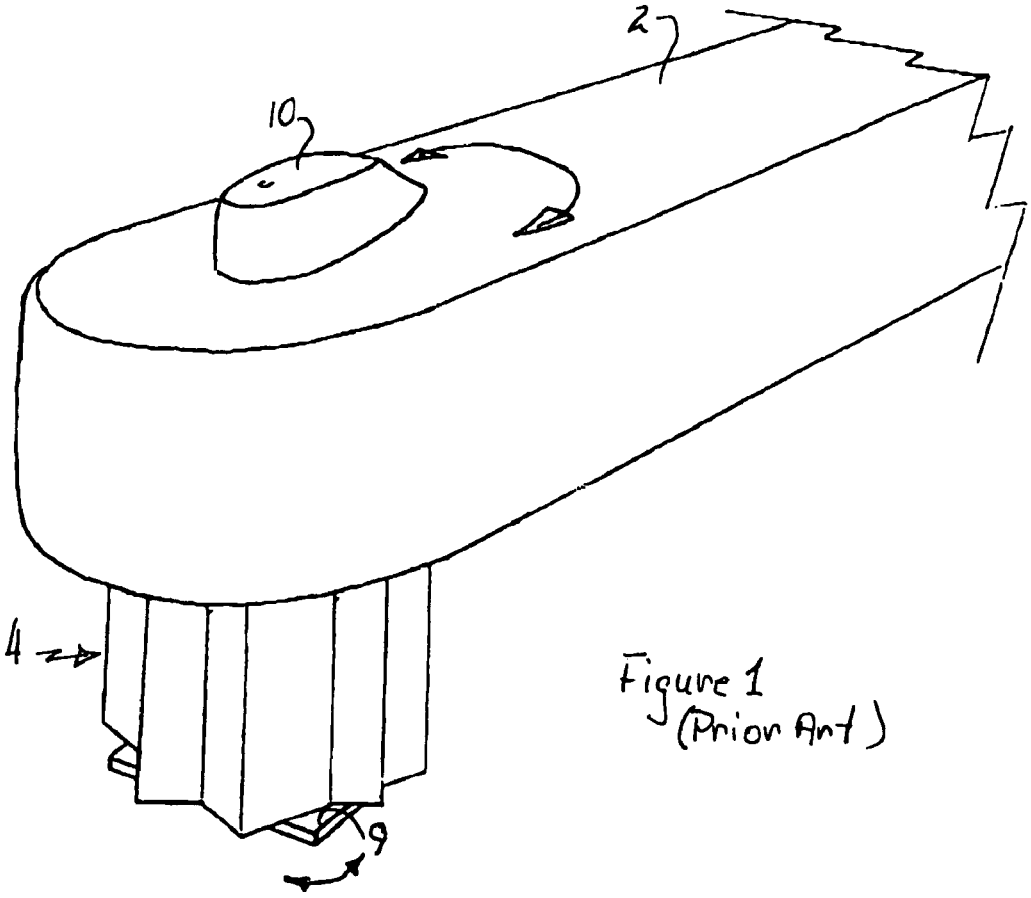
Figure 1 (Prior Art)
FIG. 1 is a perspective view of a drive end of a crank of the prior art.

A crank handle for operating a winch incorporating features of the present invention is illustrated in the figures. Although the present invention will be described with reference to the embodiments shown in the drawings, it should be understood that the present invention may have many alternate forms. In addition, any suitable size, shape or type of elements or materials could be used.

Figure 2A:
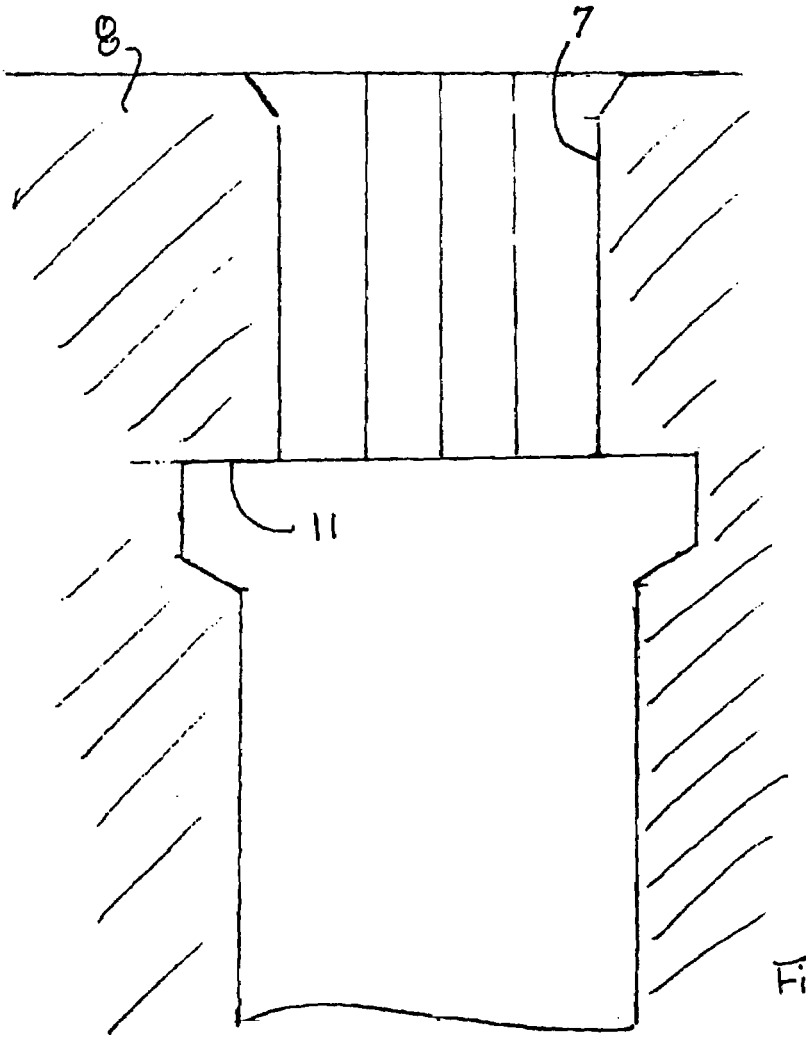
Figure 2a (Prior Art)
FIG. 2*a* is a sectional side view of a winch drum employing an octagonal socket, taken along section lines 1—1 of FIG. 2*b;*
Figure 2B:
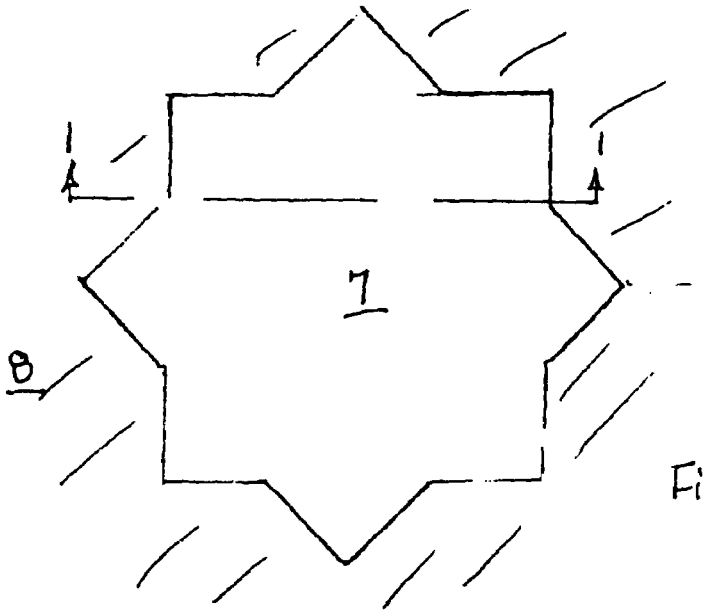
Figure 2b (Prior Art)
FIG. 2*b* is a top view of the winch drum socket of FIG. 2*b;*
Figure 7:
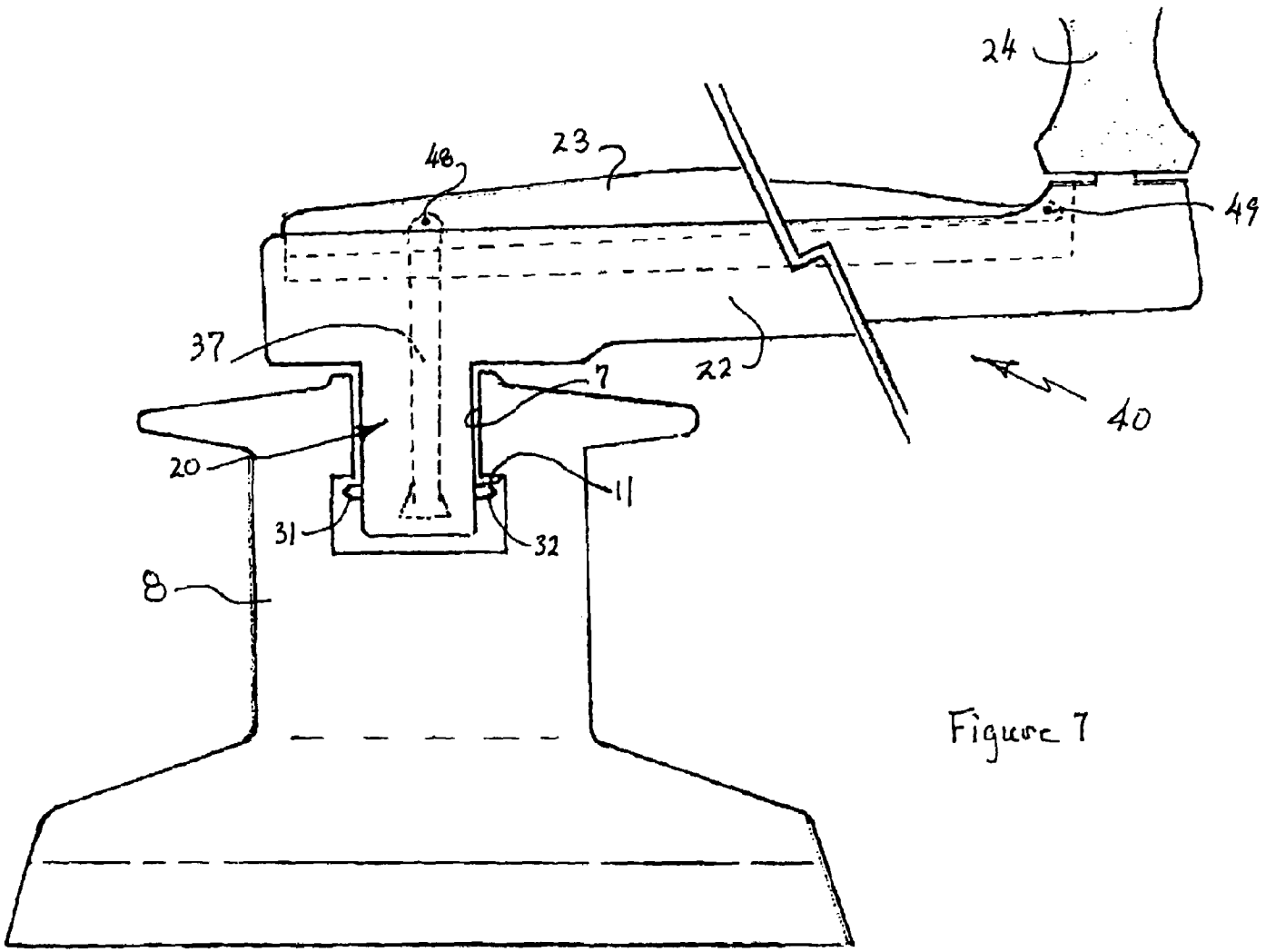
FIG. 7 is a side view of the winch assembly including the crank of this invention.

A cross-sectional view of a drive socket 7 is shown in FIG. 2*b*. A socket 7 is typically found at the top of a winch drum 8, as shown in FIG. 7. Such arrangements are of the type used for sailing. Although an octagonal opening and drive head will be referred to herein, it will be understood by one skilled in the art that any suitably shaped drive socket and mating drive head can be used, such as, for example, a square drive head and socket. Thus, the scope of the present invention is not limited to an octagonal shape, but rather encompasses any geometric shape that might be considered for a driving engagement of a winch handle in a winch drum 8.

A typical crank 1 for a winch 8 is shown in FIG. 1 It is comprised of a crank arm 2, a handle attached to crank arm 2 (not shown), a drive head 4, and a locking mechanism, such as locking plate 9. The Handle is generally connected to the crank arm 1 by means that allow the handle to rotate on the crank arm. This is to facilitate grabbing the handle and rotating the crank arm 2 about its axis. A drive head 4 is shown enlarged in FIG. 1 and comprises a male portion that is constructed with a cross section to match the drive socket 7 of the winch drum 8, as shown in FIGS. 2*a* and 2*b*. A locking plate 9 is attached to an actuator lever 10 through the drive head 4 and may be rotated into alignment with the cross-section of the drive head by turning actuator lever 10. This movement allows the crank 1 to be installed or released from the winch drum 8. In the locked position the locking plate 9 interferes with the shoulder 11 of socket 7. A side cross-section of the drive socket 7, that is in most general use, is shown in FIG. 2*a*.

Figures 3, 4:
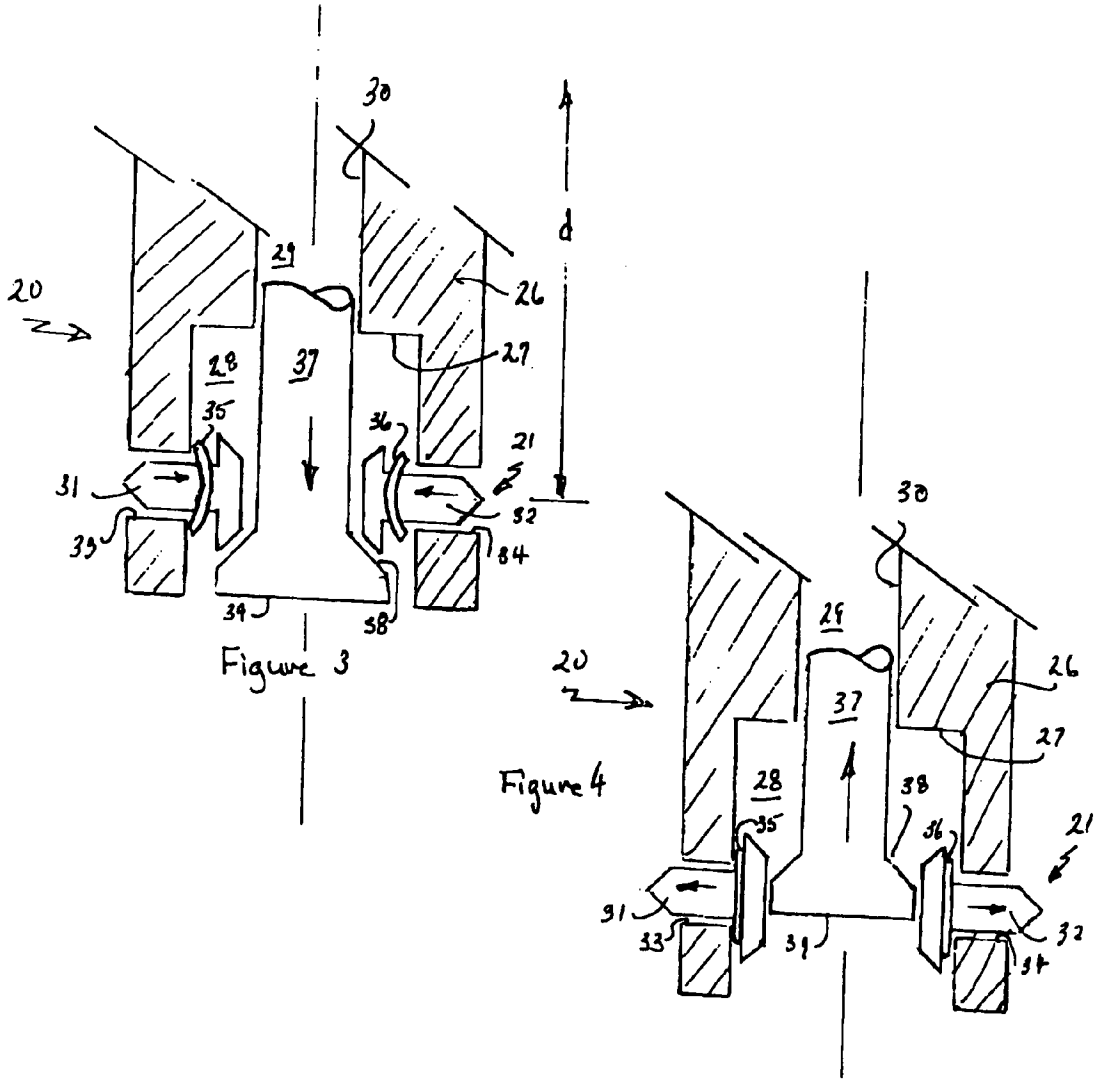
FIG. 3 is a side sectional view of the drive head of the crank of this invention with the actuation shaft in the releasing position.
FIG. 4 is a side sectional view of the drive head of FIG. 3 with the actuation shaft in locking position.

An embodiment of this invention is shown in FIGS. 3–6, and is adapted to be used with the socket configuration of FIGS. 2*a* and 2*b*. The improved drive head 20 and lock/release mechanism 21 of this embodiment is shown in FIGS. 3–5 and is formed at the drive end 41 of crank 40. Drive head 20 is constructed with a male portion 26 extending downward from crank arm 22, as shown in FIG. 6. Male portion 26 is formed having a cross section for mating with a drive socket, such as socket 7, shown in FIGS. 2*a* and 2*b*. An axial bore 30 is formed in drive head 20 to accommodate the lock/release mechanism 21. Bore 30 is formed in two sections, upper section 29 and lower section 28. Lower section 28 has a larger diameter resulting in a shoulder 27. Lock/release mechanism 21 comprises a pair of pins 31 and 32 that are mounted for sliding motion in transverse extending pin bores 33 and 34.

Figure 5A:
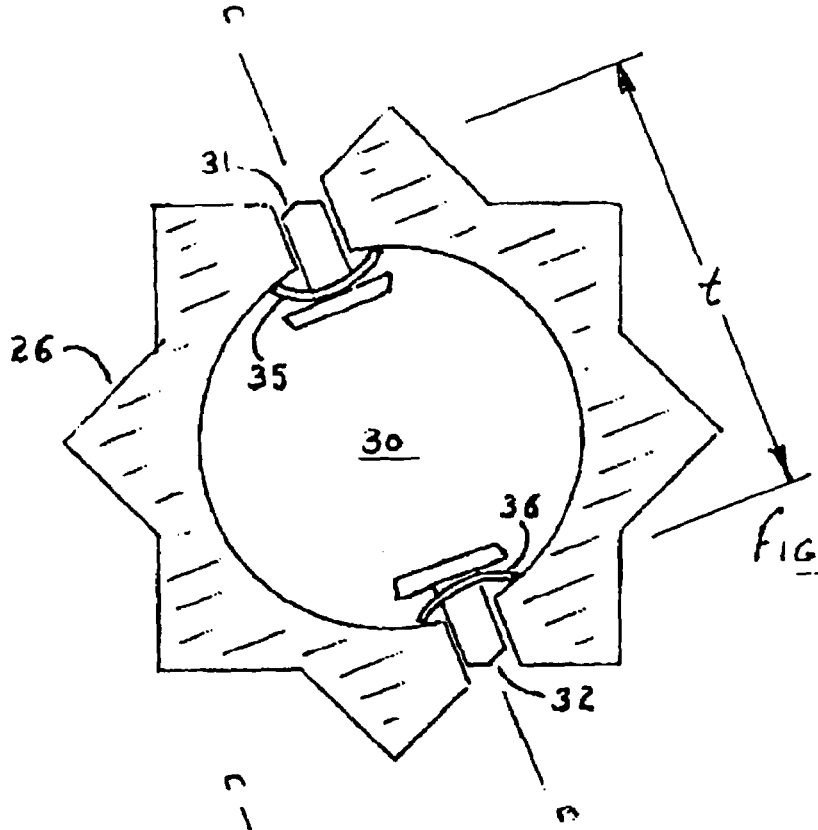
FIG. 5*a* is a top cross sectional view of the drive head showing the position of the pins in the releasing position.
Figure 5B:
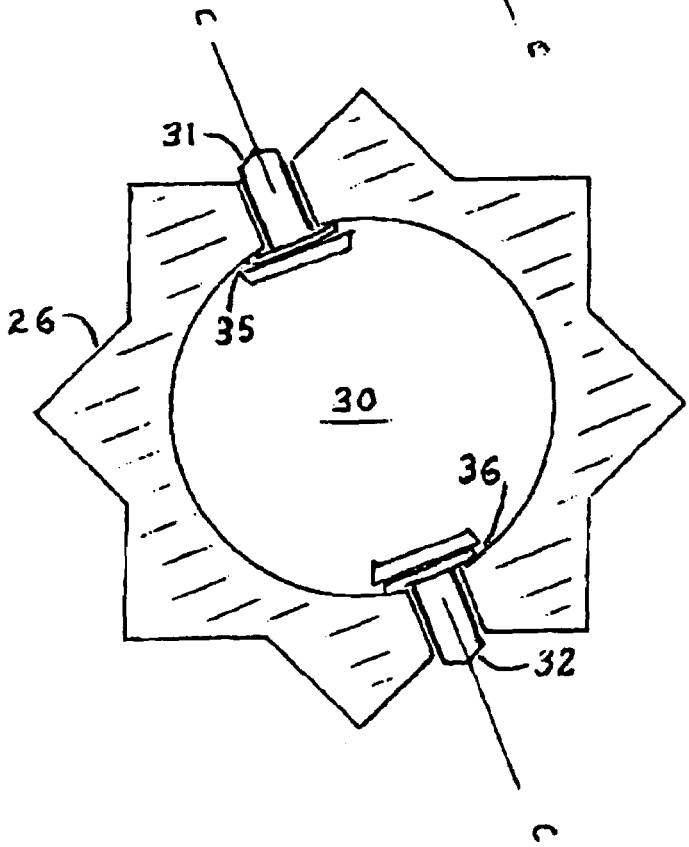
FIG. 5*b* is a top cross sectional view of the drive head showing the position of the pins in the locking position.

Pin bores 33 and 34 communicate with axial bore 30 and are located on the male portion 26 of drive head 20 at a depth d from crank arm 22 that will be just below the shoulder 11 of the drive socket 7, when the crank 30 is fully engaged for operation. As shown in FIGS. 5*a* and 5*b*, the pin bores 33 and 34 may be advantageously located in a transverse plane, so that an outer exit 35 is at a point where the thickness t of the male portion 26 is smallest and are aligned substantially on an axis c—c through the center of the cross-section, as shown in FIGS. 5*a* and 5*b*.

Although in the preferred embodiment shown in the figures, a pair of pins 31 and 32 are used, it is envisioned that in other applications a single pin or any number of multiple pins could be used.

Pins 31 and 32 are assembled in pin bores 33 and 34 respectively and are spring biased towards the release position, as shown in FIGS. 4 and 5*b*, by cup shaped spring washers 35 and 36. An actuating shaft 37 is mounted in the axial bore 30 for sliding motion therein. Actuating shaft 37 is constructed with an enlarged cam surface 38 at its lower end 39 for engagement with the inner heads of locking pins 31 and 32. Cam surface 38 is shaped to conform generally with the shape of the inner heads of the pins to provide a mating engagement.

As actuating shaft 37 moves upward in bore 30, it will engage locking pins 31 and 32 and force each of the pins against the bias force of spring washers 35 and 36 to extend out of the pin bores and engage the shoulder 11. Upward movement of the shaft 37 is limited so that in a first position it remains engaged with the pins and the crank is locked in the drive socket 7. Downward movement of the shaft 37 is also limited so that in a second position, the pins are allowed to retract under the bias force of the spring washers, thereby releasing the crank from the winch.

As best shown in FIG. 6, in order to conveniently actuate the lock/release mechanism of the drive head 20, crank 40 is provided with a grip lever 23, to cause movement of actuating shaft 37 up and down in bore 30. Lever 23 is mounted for pivot motion on crank arm 22 by a pinned joint to provide a fulcrum 49 at the distal end of crank arm 22. A handle 24 is mounted at the distal end of crank arm 22 in a well known manner.

Figures 6A, 6B:
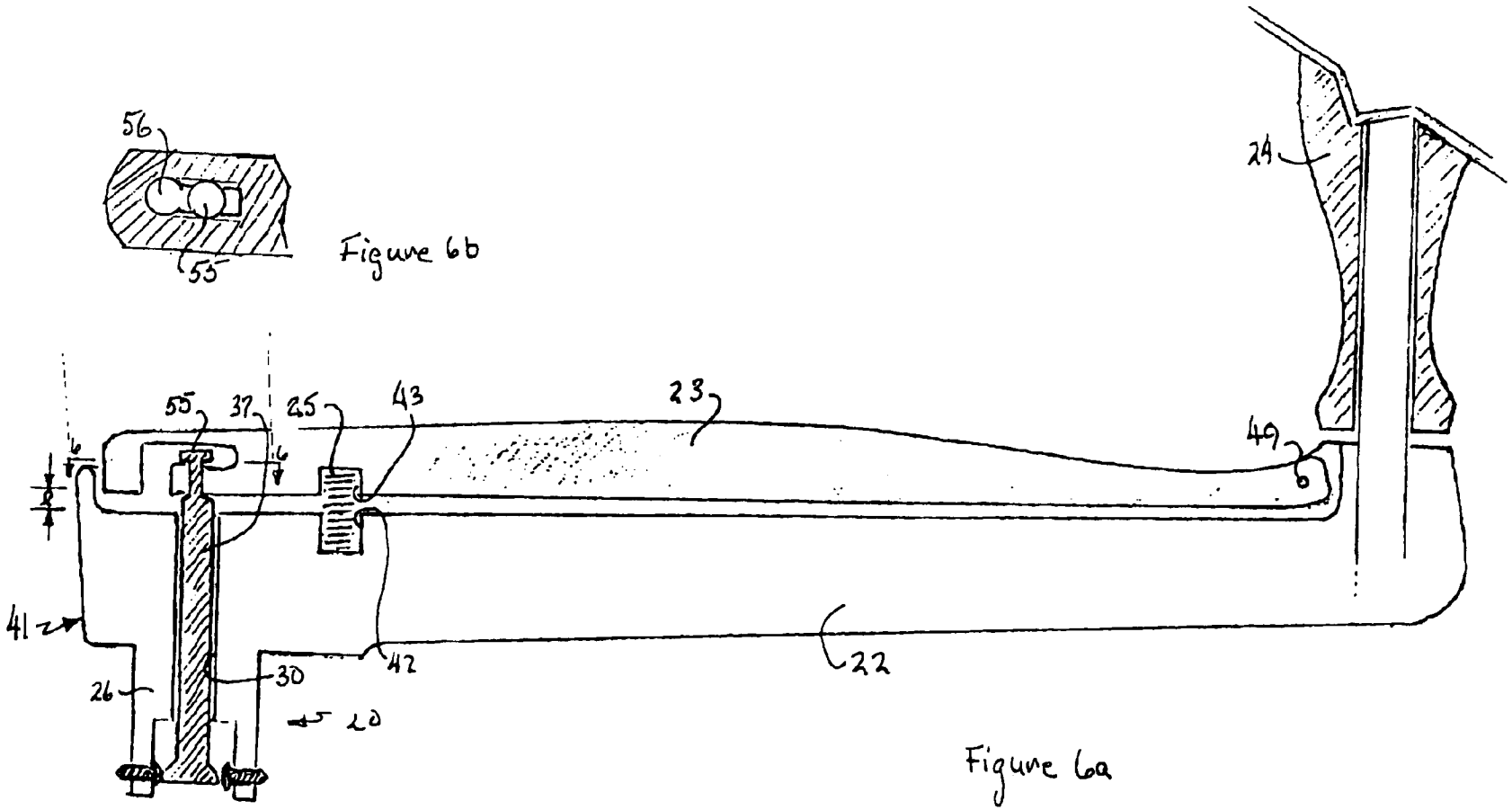
FIG. 6*a* is a side view of the crank assembly of this invention.
FIG. 6*b* is a sectional view of the crank assembly of FIG. 6*a*, along section lines 6—6.

Actuating shaft 37 may be pinned to the drive end of grip lever 23 by a pin 48, as shown in FIG. 7, to allow a slight pivot motion between shaft 37 and lever 23. In another embodiment, actuating shaft 37 is constructed with a head 55 that engages a key hole shaped slot 56 constructed in grip lever 23, as shown in FIGS. 6*a* and 6*b*.

Lever 23 is biased upward by a coil spring 25 captured in aligned bores 43 on lever 23 and 42 on crank arm 22, as shown in FIG. 6. Other biasing arrangements may be used without deviating from the scope of this invention. It is observed that by biasing grip lever 23 so that it pivots away from crank arm 22, the lock/release mechanism 21 is maintained in the locked position.

By griping lever 23 and closing the distance 1 between lever 23 and crank arm 22, actuating shaft 37 will move downward in bore 30 and release the pins 31 and 32 into a retracted position. The drive head 20 of crank 40 may, accordingly, be engaged in drive socket 7. With the release of the grip lever 23, it travels upward, pulling actuation shaft 37 with it and forcing pins 31 and 32 into engagement with shoulder 11.

Figure 8:
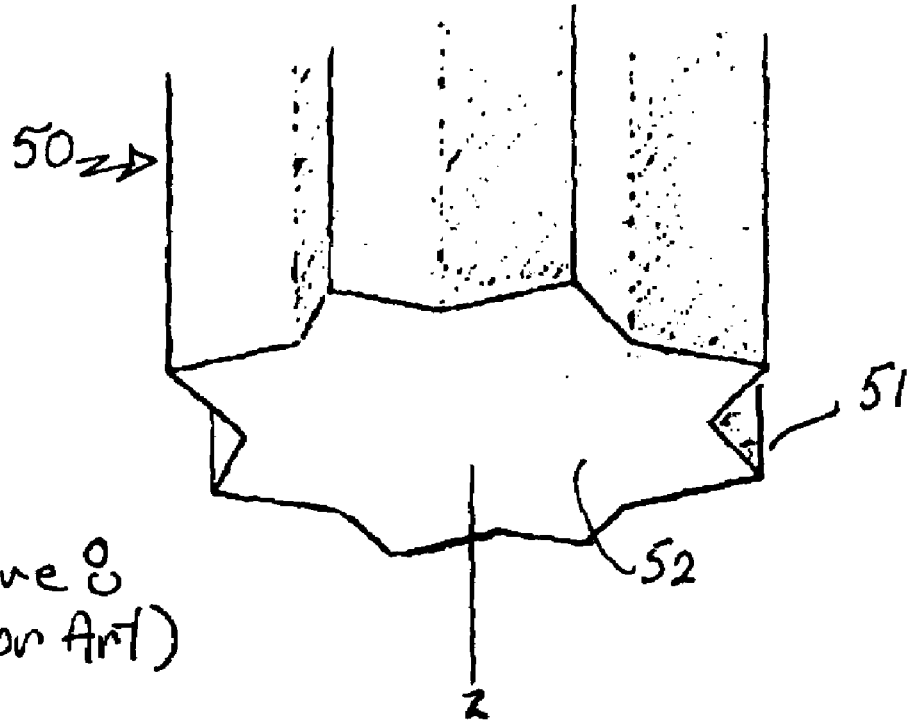
Figure 8 (Prior Art)
FIG. 8 is a perspective view of the insertion end of a drive head of the prior art.

As shown in FIG. 8, the insertion end 51 of a typical drive head 50 for a crank is cut in a transverse plane to the axis z of the drive head 51. This presents a flat surface 52 having an octagonal profile.

Figure 9:
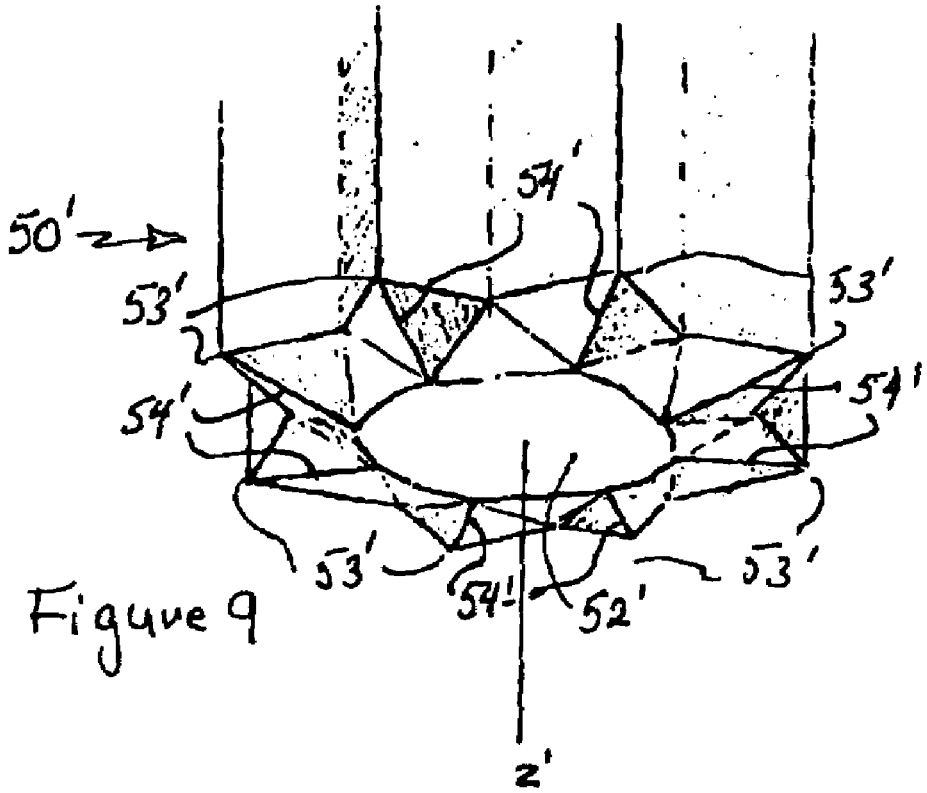
FIG. 9 is a perspective view of the insertion end of the drive head according an embodiment of this invention.

To facilitate alignment of the drive head and socket, the profile of the drive head 50', at its insertion end, is altered, as shown in FIG. 9. The octagonal shape of the drive head 50' at its insertion end 51' is defined by 8 triangular shaped projections 53' extending the length of the drive head, parallel with the longitudinal axis z' of the drive head 50'. According to this invention, the sides of each of the triangular projections 53' are beveled at an angle upward from the plane of the surface 52' of insertion end 51'. Each of the beveled sides of a projection will intersect in a line which is also beveled upward in a plane through the point of the projections 53'. This results in the engaging surface of the drive head presenting a compound beveled surface 54' on each of the triangular projections, thereby facilitating insertion of the drive head in the socket.

In this manner a crank for a winch is constructed that can be conveniently and reliably engaged utilizing one hand. In addition the locking mechanism is more protected from weather and damage.

It should be understood that the above description is only illustrative of the invention. Various alternatives and modifications can be devised by those skilled in the art with out departing from the invention. Accordingly, the present invention is intended to embrace all such alternatives, modifications and variances which fall with the scope of the appended claims.

I claim:

1. A cranking device for operating a winch, said winch having a drive socket constructed therein, said cranking device comprising:

an elongated crank arm having a drive head constructed at one end and a handle constructed at the other;

wherein said drive head further comprises:

a male portion extending outward from said crank arm to a distal end, said male portion having a cross section that mates with the drive socket of the winch for driving engagement therewith when the distal end is inserted in the drive socket;

an axially extending bore constructed in said drive head;

at least one, pin bore constructed in said male portion transverse to and in communication with said axially extending bore;

at least one locking pin mounted in said at least one pin bore for sliding motion between a release position and a locking position, said pin extending outward from said male portion when in the locking position; and an actuating rod mounted for movement in said axial bore and operatively associated with said at least one locking pin for moving said at least one locking pin between the release position and the locking position;

and a grip lever mounted for pivot movement on said crank arm, said grip lever operatively connected to said actuating rod to cause the actuating rod to move said at least one locking pin between the release position and the locking position.

2. A cranking device, according to claim 1, wherein said grip lever extends parallel to and substantially coextensive with said crank arm.

3. A cranking device, according to claim 1, wherein said grip lever is spring biased away from said crank arm in a first position and the action of gripping the grip lever moves said lever towards said crank arm to a second position and further wherein said at least one locking pin is in the locking position in said first position of the grip lever and is in the release position in said second position of the grip lever.

4. A cranking device, according to claim 1, wherein the at least one locking pin comprises a pair of locking pins mounted in pin bores in the male portion, said pin bores constructed on diametrically opposite sides of said male portion, and said pins being spring biased towards the release position.

5. A cranking device, according to claim 4, wherein said actuating rod extends within said axial bore below said pin bores and is constructed with a cam surface at a lower end which engages the locking pins such that upward movement of the actuating rod forces the locking pins into the locking position.

6. A cranking device according to claim 4, wherein the mating cross section of the male portion is formed by a plurality of axially extending triangular projections and said pins are placed where the thickness of the male portion is smallest.

7. A cranking device according to claim 1, wherein said at least one locking pin is spring biased towards the release position.

8. A cranking device according to claim 7, wherein said at least one locking pin is spring biased towards the release position by a spring washer.

9. A cranking device according to claim 1, wherein the distal end of the male portion is formed by a plurality of axially extending triangular projections and said triangular projections are cut at an angle to a plane transverse to the axis of the drive head to provide an engagement surface at the distal end of said male portion comprising a compound beveled surface that facilitates alignment with the drive socket.

10. A cranking device for operating a winch, said winch having a drive socket constructed therein, said cranking device comprising:

an elongated crank arm having a drive head constructed at one end;

a grip lever mounted for pivot movement on said crank arm, wherein said drive head further comprises:

a male portion extending outward from said crank arm, said male portion having a cross section that mates with the drive socket of the winch for driving engagement therewith; and a locking mechanism operatively associated with the grip lever, wherein pivot motion of the grip lever causes the locking mechanism to move between a lock position in which the drive head is locked within the drive socket and a release position, wherein said drive head is removable from said drive socket.

11. A cranking device, according to claim 10, wherein the locking mechanism further comprises:

an axially extending bore constructed in said drive head;

an actuating rod mounted for movement in said axial bore and operatively associated with said grip lever wherein pivotal motion of said grip lever causes axial motion of said actuating rod; and wherein axial motion of the actuating rod causes the locking mechanism to move between the a lock position in which the drive head is locked within the drive socket and a release position wherein said drive head is removable from said drive socket.

12. A cranking device, according to claim 10, wherein said grip lever extends parallel to and substantially coextensive with said crank arm.

13. A cranking device, according to claim 10, wherein said grip lever is spring biased away from said crank arm in a first position and the action of gripping the grip lever moves said lever towards said crank arm to a second position and further wherein said locking mechanism is in the lock position in said first position of the grip lever and is in the release position in said second position of the grip lever.

14. A cranking device according to claim 10, wherein the distal end of the male portion is formed by a plurality of axially extending triangular projections and said triangular projections are cut at an angle to a plane transverse to the axis of the drive head to provide an engagement surface at the distal end of said male portion comprising a compound beveled surface that facilitates alignment with the drive socket.

* * * * *